US011735348B2

(12) United States Patent
Sun et al.

(10) Patent No.: US 11,735,348 B2
(45) Date of Patent: Aug. 22, 2023

(54) MAGNETIC COMPONENT

(71) Applicant: Delta Electronics (Shanghai) Co., Ltd., Shanghai (CN)

(72) Inventors: Jun Sun, Shanghai (CN); Zengyi Lu, Shanghai (CN); Jinfa Zhang, Shanghai (CN); Xicun Fan, Shanghai (CN)

(73) Assignee: Delta Electronics (Shanghai) Co., Ltd., Shanghai (CN)

( * ) Notice: Subject to any disclaimer, the term of this patent is extended or adjusted under 35 U.S.C. 154(b) by 1154 days.

(21) Appl. No.: 16/203,571

(22) Filed: Nov. 28, 2018

(65) Prior Publication Data

US 2019/0198220 A1 Jun. 27, 2019

(30) Foreign Application Priority Data

Dec. 26, 2017 (CN) ..... 201711431995.7

(51) Int. Cl.

| | |
|---|---|
| ***H01F 17/04*** | (2006.01) |
| ***H01F 27/32*** | (2006.01) |
| ***H01F 27/30*** | (2006.01) |
| ***H01F 27/24*** | (2006.01) |
| ***H01F 27/28*** | (2006.01) |

(52) U.S. Cl.

CPC ..... *H01F 27/24* (2013.01); *H01F 27/2823* (2013.01); *H01F 27/303* (2013.01); *H01F 27/306* (2013.01); *H01F 27/323* (2013.01); *H01F 27/324* (2013.01); *H01F 27/325* (2013.01)

(58) Field of Classification Search

CPC ..... H01F 27/24; H01F 27/306; H01F 27/325; H01F 27/323; H01F 27/324

USPC ..... 336/221

See application file for complete search history.

(56) References Cited

U.S. PATENT DOCUMENTS

| | | | | |
|---|---|---|---|---|
| 4,197,348 A * | 4/1980 | Townsend | H01F 41/122 | 242/439.6 |
| 4,261,191 A * | 4/1981 | Suzuki | B21C 47/04 | 72/143 |
| 5,254,806 A * | 10/1993 | Gross | H01B 13/106 | 174/124 R |
| 5,861,071 A * | 1/1999 | McBane | H01F 41/068 | 156/54 |
| 5,988,545 A * | 11/1999 | King | B65H 55/04 | 242/178 |
| 6,087,922 A * | 7/2000 | Smith | H01F 41/0233 | 336/200 |
| 6,274,240 B1 * | 8/2001 | McBane | H01F 41/068 | 428/397 |

(Continued)

FOREIGN PATENT DOCUMENTS

| | | |
|---|---|---|
| CN | 102436915 A | 5/2012 |
| CN | 202839244 U | 3/2013 |

(Continued)

*Primary Examiner* — Mang Tin Bik Lian
*Assistant Examiner* — Joselito S. Baisa
(74) *Attorney, Agent, or Firm* — CKC & Partners Co., LLC

(57) ABSTRACT

The present application discloses a magnetic component, comprising a magnetic core comprising at least one core column; a winding winded on the core column and comprising a first coil and a second coil adjacent to the first coil; a cladding member covered on at least a portion of an external surface of the first coil; and a positioning member extending from the cladding member and the first coil, wherein the second coil is pressed on the positioning member.

12 Claims, 3 Drawing Sheets

(56) References Cited

U.S. PATENT DOCUMENTS

| | | | | |
|---|---|---|---|---|
| 7,050,602 | B2 * | 5/2006 | Miller | H04R 25/554 381/418 |
| 8,829,888 | B2 * | 9/2014 | Chamarti | G01R 15/181 324/76.11 |
| 9,177,714 | B2 * | 11/2015 | Espino | H01F 27/325 |
| 9,666,354 | B2 * | 5/2017 | Zuo | H01F 27/2804 |
| 9,722,499 | B2 * | 8/2017 | Martin | H01F 38/00 |
| 2003/0196828 | A1 * | 10/2003 | Schilson | B29C 66/8165 174/117 F |
| 2004/0257188 | A1 * | 12/2004 | Younger | H01F 41/068 336/170 |
| 2013/0082809 | A1 * | 4/2013 | Holden | H01R 4/022 174/84 R |
| 2017/0110241 | A1 * | 4/2017 | Yang | H01F 27/346 |
| 2017/0163145 | A1 * | 6/2017 | Cheng | H02M 1/12 |

FOREIGN PATENT DOCUMENTS

| | | | | | |
|---|---|---|---|---|---|
| CN | 202977109 | U | * | 6/2013 | |
| CN | 102436915 | B | | 7/2014 | |
| CN | 205177580 | U | | 4/2016 | |
| CN | 105990011 | A | | 10/2016 | |
| CN | 106024373 | A | | 10/2016 | |
| CN | 206349234 | U | | 7/2017 | |
| CN | 206421891 | U | | 8/2017 | |
| CN | 206497822 | U | | 9/2017 | |
| EP | 2320440 | A1 | * | 5/2011 | H01F 27/323 |
| GB | 2283864 | A | * | 5/1995 | H01F 27/25 |
| JP | 11067552 | A | * | 3/1999 | |
| JP | 3824929 | B2 | * | 9/2006 | |
| JP | 2013528895 | A | * | 7/2013 | |
| JP | 2013254771 | A | * | 12/2013 | |
| JP | 2014204002 | A | * | 10/2014 | |

* cited by examiner

MAGNETIC COMPONENT

CROSS-REFERENCE TO RELATED APPLICATIONS

This non-provisional application claims priority under 35 U.S.C. § 119(a) on Patent Application No. 201711431995.7 filed in P.R. China on Dec. 26, 2017, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

BACKGROUND OF THE INVENTION

1. Field of the Application

The present application relates to a magnetic component, and specifically, relates to a magnetic component which is capable of improving a fixing strength of the winding.

2. Related Art

With an increasing of demand for a power density of the magnetic component, the challenge to technicians is higher. Currently, most of the magnetic components are formed of a magnetic core, a winding and a bobbin. However, the bobbin for winding cannot improve the electrical performance while occupying about 30% of volume of a winding space in the magnetic component, so the technicians are considering omitting the bobbin of the magnetic component.

In the existing magnetic component without bobbin, the winding is often fixed by tapes on four sides. However, such fixing method is complicated in operation and low in efficiency, and may easily lead to collapse of winding formation, looseness of winding and the like, such that the potential problem in quality of the magnetic component may exist. Therefore, there is an urgent requirement to develop a winding structure for overcoming the above defects.

SUMMARY OF THE INVENTION

In order to overcome the existing problems in the prior art, an object of the present application is to provide a magnetic component, comprising: a magnetic core comprising at least one core column; a winding wound on the core column and comprising a first coil and a second coil adjacent to the first coil; a cladding member covered on at least a portion of an external surface of the first coil; and a positioning member extending from the cladding member and the first coil, wherein the second coil is pressed on the positioning member.

As compared to the prior art, the present application may have the following advantage.

The cladding member and the positioning member extending from the cladding member are disposed on the external surface of the coil, and the positioning member is pressed by at least one turn of another coil, so as to improve the fixing strength of the winding and reduce the potential problem in quality.

DETAILED DESCRIPTION OF THE INVENTION

The present application will be described in detail with reference to the drawings and the specific embodiments, which are implemented on the premise of the technical solution of the present application to interpret the implementing manner and the operating process. However, the protection scope of the present application is not limited to the specific embodiments.

Figure 1:
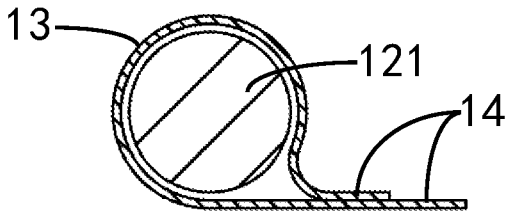
FIG. 1 is a structure diagram of a first embodiment of a cladding member in the present application.
Figure 2:
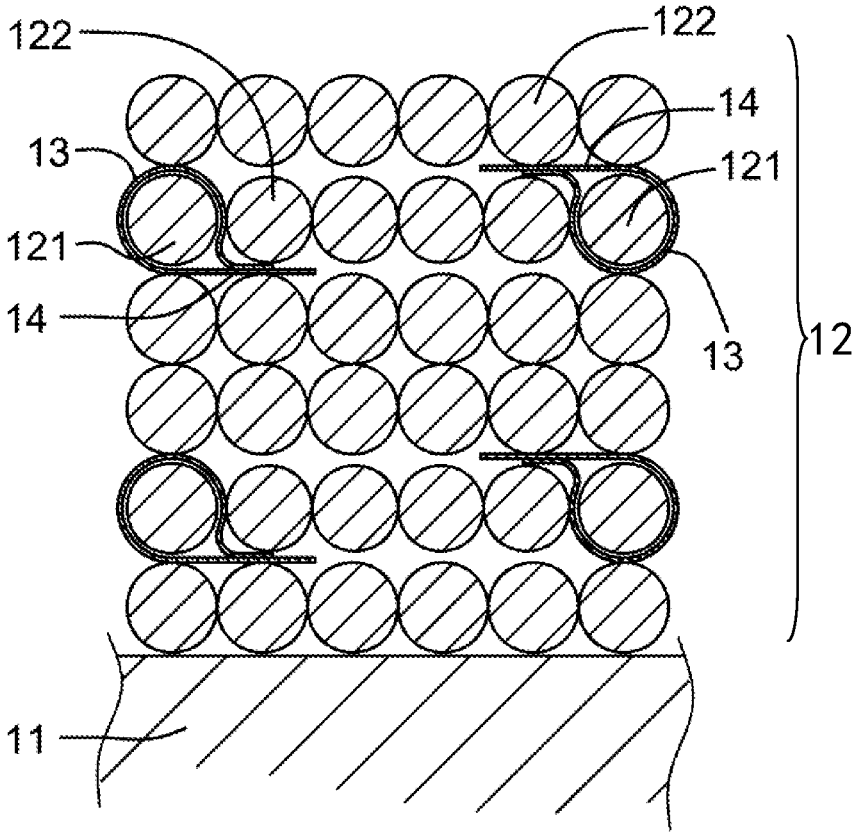
FIG. 2 is a structure diagram of a first embodiment of a magnetic component in the present application.

Please refer to FIGS. 1 and 2. FIG. 1 is a structure diagram of a first embodiment of a cladding member in the present application, and FIG. 2 is structure diagram of a first embodiment of a magnetic component in the present application. As shown in FIGS. 1 and 2, the magnetic component comprises a magnetic core comprising at least one core column 11; a winding 12 wound on the core column 11 and comprising a first coil 121 and a second coil 122 adjacent to the first coil 121; a cladding member 13 covered on at least a portion of an external surface of the first coil 121; and a positioning member 14 extending from the cladding member 13 and the first coil 121. The positioning member 14 is pressed by the second coil 122 to improve the fixing strength of the winding and reduce the potential problem in quality. Further, the positioning member 14 of the first coil 121 may have adhesiveness to be pressed more tightly by the second coil 122.

In this embodiment, the winding 12 may be a multi-layered winding. However, the present application is not limited thereto. In other embodiment, the winding 12 may be a single-layered winding. Moreover, the present application will not limit the number of the first coil 121. The winding 12 may include multiple groups of the first coil 121, the cladding member 13 and the positioning member 14, and the first coil 121 may be any turn of the winding 12. Preferably, as shown in FIG. 2, as for a coil on a certain layer of the winding 12, only a portion of the coil may be configured as the first coil 121, such that the coil space occupied by the cladding member 13 and the positioning member 14 can be minimized while improving the fixing strength of the winding, so as to ensure the power density of the magnetic component.

Explanations will be made in detail by taking FIG. 2 for example. In one embodiment of the present application, if the winding 12 is wound in a direction from left to right, and an inner layer to an outer layer of the magnetic component are arranged in a direction from bottom to top, the positioning member 14 of the first coil 121 on the leftmost is at least pressed by the second coil 122 adjacent to the first coil 121 on the right side, i.e., pressed by the coil on the same layer, and the positioning member 14 of the first coil 121 on the rightmost is at least pressed by the second coil 122 adjacent to the first coil 121 on the upper layer. In other words, the first coil 121 and the second coil 122 may be on a same layer or different layers of the winding 12. The actual winding may be correspondingly adjusted according to the winding manner of the magnetic component, only if the positioning member 14 of the first coil 121 is pressed by any turn of the second coil 122 adjacent to the first coil 121. Moreover, the second coil 122 may also be provided with the cladding member 13 and the positioning member 14.

Further, in order to improve the insulating performance of the magnetic component, the cladding member 13 and the positioning member 14 of the present application may be made of insulating material, and at least one of the number of layers of the cladding member 13, the position of the cladding member 13 and the length of the positioning member 14 can be adjusted according to safety requirements. For example, the magnetic component may comprise an insulating tape, the winding 12 is prepared by winding a conducting wire, and the insulating tape is adhered to at least a portion of the conducting wire by pinching. When the conducting wire is wound on the magnetic core, the adhered insulating tape may form the cladding member 13 as shown in FIG. 1. Moreover, the insulating tape forming the positioning member 14 may not be completely aligned, and a portion of the adhesive surface (a surface with adhesive layer) of the insulating tape is exposed, such that the positioning member 14 may have adhesiveness to be pressed more tightly by the second coil 122. During the actual winding process, a position of the first coil 122 on the winding 12, i.e., a position of the cladding member 13, can be controlled conveniently by adjusting a position of the insulating tape adhered on the conducting wire. For example, when the magnetic component is a transformer wound by sequentially stacking a primary side and a secondary side, at least one turn of coil at each end of a secondary winding and/or a primary winding may be covered with the insulating tape to improve the insulating performance of the magnetic component.

Figure 3:
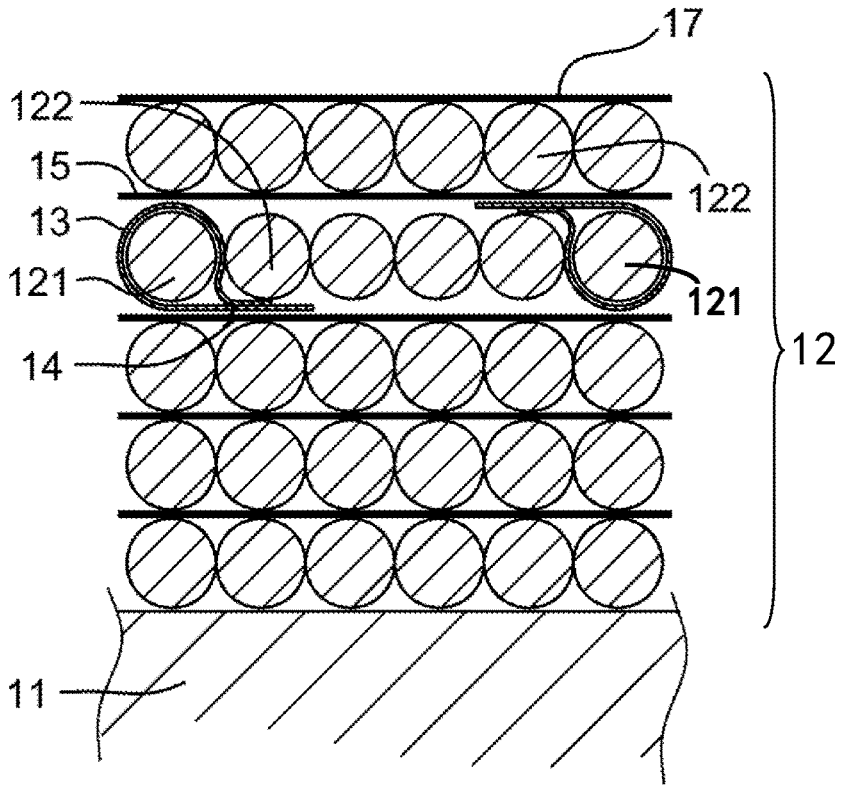
FIG. 3 is a structure diagram of a second embodiment of a magnetic component in the present application.

Please refer to FIG. 3. FIG. 3 is a structure diagram of a second embodiment of a magnetic component in the present application. As compared to the first embodiment of the magnetic component as shown in FIG. 2, the magnetic component in the second embodiment further comprises an interlayer tape 15 disposed between adjacent two layers of the winding 12, wherein the positioning member 14 is pressed by both of the interlayer tape 15 and the second coil 12 to further improve the fixing strength of the winding. Explanations will be made by taking FIG. 3 for example. If the winding 12 is wound in a direction from left to right, and an inner layer to an outer layer of the magnetic component are arranged in a direction from bottom to top, at least the adjacent second coil 122 on the right side and the interlayer tape 15 on the upper side are both pressed on the positioning member 14 of the first coil 121 on the leftmost, and at least the adjacent second coil 122 on the upper side and the interlayer tape 15 on the upper side are both pressed on the positioning member 14 of the first coil 121 on the rightmost. Further, the magnetic component may comprise an outer tape 17 pressed on an outermost layer of the winding 12 to further improve the fixing strength of the winding. On the other hand, in order to improve the insulating performance of the magnetic component, the interlayer tape 15 and/or the outer tape 17 may be made of insulating material.

Figure 4:
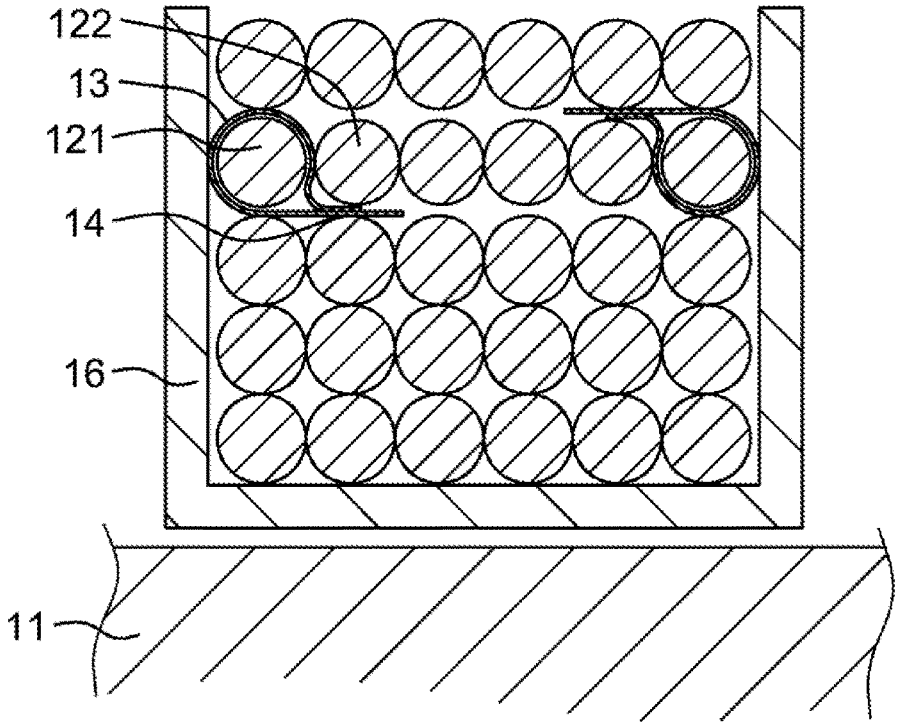
FIG. 4 is a structure diagram of a third embodiment of a magnetic component in the present application.

Please refer to FIG. 4. FIG. 4 is a structure diagram of a third embodiment of a magnetic component in the present application. The fixing structure of the present application may also be applied to a magnetic component including a bobbin. As shown in FIG. 4, the winding 12 is wound on the magnetic core 11 through a bobbin 16, i.e., the bobbin 16 is disposed between the winding 12 and the magnetic core 11.

It is to be noted that the structures of the cladding member and the positioning member in FIGS. 1 to 4 are only exemplary examples, and other structure may be formed by varying the fabricating method.

Figure 5:
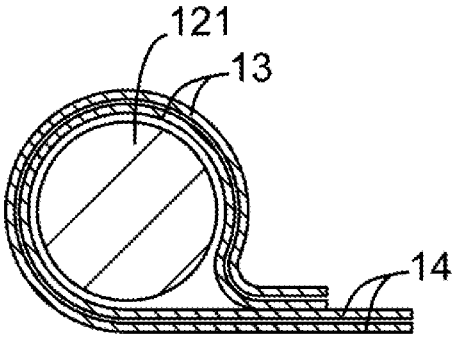
FIG. 5 is a structure diagram of a second embodiment of a cladding member in the present application.

Please refer to FIG. 5. FIG. 5 is a structure diagram of a second embodiment of a cladding member in the present application, and differs from FIG. 1 in that the cladding member 13 in FIG. 5 has a multilayer structure and a multi-layered cladding member 13 is covered on an external surface of the first coil 121 by pinching. Explanations will be made by taking the insulating tape for example. The winding 12 is prepared by winding a conducting wire, and a pre-prepared multi-layered insulating tape is pinched on at least a portion of the conducting wire. When the conducting wire is wound on the magnetic core, the adhered insulating tape may form the multi-layered cladding member as shown in FIG. 5.

Figure 6:
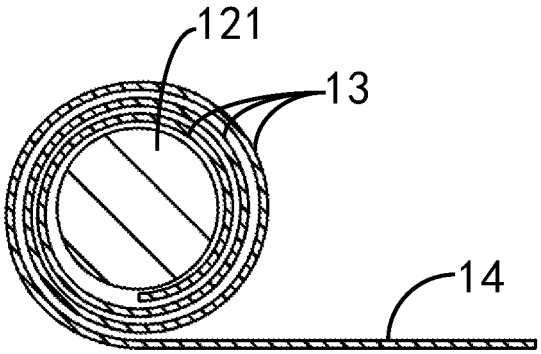
FIG. 6 is a structure diagram of a third embodiment of a cladding member in the present application.

Please refer to FIG. 6. FIG. 6 is a structure diagram of a third embodiment of a cladding member in the present application, and differs from FIG. 5 in that the multi-layered cladding member 13 is covered on an external surface of the first coil 121 by winding. Explanations will be made by taking the insulating tape for example. The winding 12 is prepared by winding a conducting wire, and the insulating tape is adhered to at least a portion of the conducting wire by winding several times. When the conducting wire is wound on the magnetic core, the adhered insulating tape may form the multi-layered cladding member as shown in FIG. 6.

Figure 7:
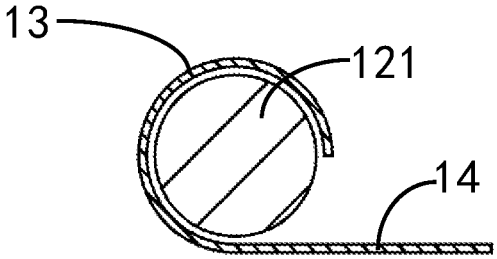
FIG. 7 is a structure diagram of a fourth embodiment of a cladding member in the present application.

It is to be noted that the structures of the cladding member in FIGS. 1, 5 and 6 are enclosed structures. However, the present application is not limited thereto. As shown in FIG. 7, the cladding member 13 may be only covered on a portion of an external surface of the first coil 121. The present application will not limit the specific structures of the cladding member and the positioning member, only if the positioning member 14 is pressed by the second coil. Moreover, the structures of the cladding member and the positioning member in FIGS. 5 to 7 may also be applied to the magnetic components in FIGS. 2 to 4, and the detailed explanation will be omitted.

In conclusion, the fixing strength of the winding can be improved through the winding structure of the present application, such that the reliability of the magnetic component, especially the reliability of the magnetic component without bobbin, may be improved. Further, when the cladding member and the positioning member are made of insulating material, an insulating performance between the coils can be improved, and safety requirement can be satisfied by adjusting at least one of the number of layers of the cladding member 13, the position of the cladding member 13 and the length of the positioning member 14, so as to improve safety assurance.

It is to be noted that, the specific embodiments are merely provided to explain the present application, instead of limiting the technical solution of the present application. Meanwhile, although the Description explains the present application in detail with reference to the specific embodiments, those having ordinary knowledge in the technical field shall understand that modifications or equivalent replacements may be made to the present application. Therefore, any technical solution and its modification without departing from the spirit and scope of the present application shall be contained within the protection scope of the appended claims of the present application.

What is claimed is:

1. A magnetic component, comprising:

a magnetic core comprising at least one core column;

a winding wound on the core column and comprising a first coil and a second coil adjacent to the first coil;

a cladding member covered on at least a portion of an external surface of the first coil; and a positioning member extending from the cladding member in a direction away from the first coil, and positioned in a horizontal position different from that of the first coil, wherein the positioning member has an adhesiveness portion exposed to the second coil such that the second coil is pressed tightly on the positioning member.

2. The magnetic component according to claim 1, wherein the cladding member and the positioning member are each made of an insulating material.

3. The magnetic component according to claim 1, wherein the first coil and the second coil are disposed on a same layer of the winding.

4. The magnetic component according to claim 1, wherein the winding has a multilayer structure in which the first coil and the second coil are disposed on adjacent two layers of the winding.

5. The magnetic component according to claim 4, further comprises an interlayer tape disposed between the adjacent two layers of the winding, wherein the positioning member is pressed by the interlayer tape.

6. The magnetic component according to claim 1, wherein the cladding member has an enclosed structure.

7. The magnetic component according to claim 1 wherein the cladding member has a multilayer structure.

8. The magnetic component according to claim 1, wherein the winding has a multilayer structure, and at least one layer of the winding comprises at least one turn of the first coil disposed at each end of the winding.

9. The magnetic component according to claim 1, further comprises an insulating tape disposed on the first coil to form the cladding member and the positioning member.

10. The magnetic component according to claim 9, wherein the insulating tape is adhered to the first coil by pinching to form the cladding member and the positioning member.

11. The magnetic component according to claim 9, wherein the insulating tape is adhered to the first coil by winding to form the cladding member and the positioning member.

12. The magnetic component according to claim 1, further comprises a bobbin disposed between the winding and the magnetic core.

* * * * *